United States Patent [19]

Bickerstaff et al.

[11] Patent Number: 4,536,076

[45] Date of Patent: Aug. 20, 1985

[54] APPARATUS FOR SUPPLYING A LIQUID TO A HEATED SURFACE

[75] Inventors: Alan E. Bickerstaff, London; Austin H. Cotton, Padbury; Michael G. Ladell, Aspley Guise; David M. Neale, Leighton Buzzard, all of England

[73] Assignee: Xerox Corporation, Stamford, Conn.

[21] Appl. No.: 533,721

[22] Filed: Sep. 19, 1983

[30] Foreign Application Priority Data

Sep. 21, 1982 [GB] United Kingdom ..... 8226847

[51] Int. Cl.[3] ..... G03G 15/00

[52] U.S. Cl. ..... 355/3 FU; 355/14 FU; 118/267; 118/401

[58] Field of Search ..... 355/3 FU, 14 FU; 118/267, 268, 271, 401

[56] References Cited

U.S. PATENT DOCUMENTS

| | | | |
|---|---|---|---|
| 515,489 | 2/1894 | Duchemin | 118/267 |
| 874,359 | 12/1907 | Glass | 118/267 |
| 2,754,752 | 7/1956 | Robinson et al. | 118/267 X |
| 2,988,043 | 6/1961 | Sassenberg | 118/267 X |
| 3,810,779 | 5/1974 | Pickett et al. | 118/401 X |
| 3,833,341 | 9/1974 | Tocci | 118/401 X |
| 4,083,322 | 4/1978 | Beckman, Jr. | 355/3 FUX |
| 4,187,930 | 2/1980 | James | 118/401 X |
| 4,193,681 | 3/1980 | Tanigawa et al. | 355/3 FU |
| 4,231,653 | 11/1980 | Nagahara et al. | 355/3 FU |
| 4,458,625 | 7/1984 | Sakane et al. | 118/268 X |

*Primary Examiner*—A. C. Prescott

[57] ABSTRACT

Apparatus for supplying a liquid to a heated surface includes a distribution gallery arranged to supply the liquid to the surface. The liquid is supplied from the gallery through a series of spaced orifices each of which opens into an individual drop-forming chamber above the surface, the dimensions of each orifice and drop-forming chamber being such that some liquid always remains in each of said orifices over the range of temperatures from ambient to that of the heated surface. A pump delivers the liquid to the distribution gallery, which is situated above, and spaced from, a wick in contact with the surface.

5 Claims, 7 Drawing Figures

Fig. 4.
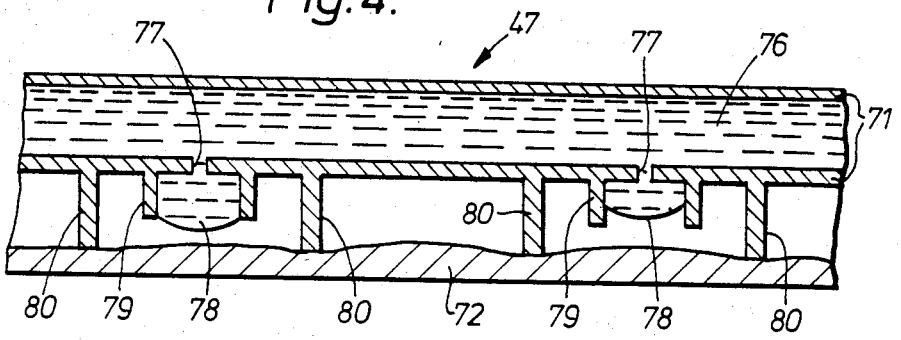
Fig. 5.
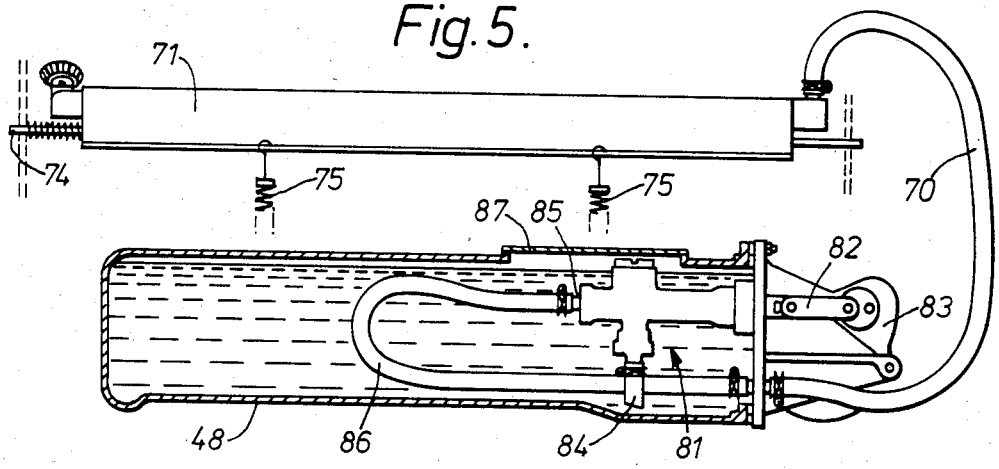
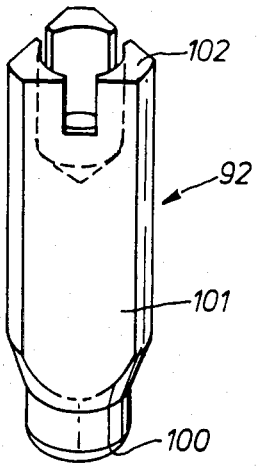
Fig. 7.

APPARATUS FOR SUPPLYING A LIQUID TO A HEATED SURFACE

BACKGROUND OF THE INVENTION

This invention relates to an apparatus for supplying a liquid to a heated surface, and particulaly, but not exclusively, to the application of release oil in the heated fuser roll of a xerographic copying machine.

In a typical plain paper zerographic copying machine, a fuser is used to permanently fix a toner image to a copy sheet. The toner consists of coloured resinous particles which, on the application of heat and pressure, become permanently bonded to the paper so as to resemble conventional printing. One problem which arises with fusers of the heated roller type is that the toner tends to adhere to the heated roller, with the result that dirty copies may then be made due to transfer of unwanted toner from the fuser roller to subsequent copy sheets. In order to prevent this, a release oil is applied to the heated fuser roller, so that none of the toner adheres to the heated roller.

In known release oil applicators for heated roller fuses, a wick is used to apply the release oil. Although generally satisfactory, capillary supply to such a wick has given rise to problems when the oil used is of relatively high viscosity. One way of solving the problem is to slowly but positively pump the release oil along a manifold which supplies oil to the applicator wick at a series of supply ports spaced along the roller. Once again a problem arises in that the oil in the manifold becomes heated by heat from the roller so that when the fuser is inoperative, and cools to room temperature, the oil contracts with the result that it tends to draw air bubbles through the supply ports and into the manifold. These air bubbles then tend to coalesce and redistribute themselves within the manifold, and may make it impossible for oil to be supplied through some of the ports, giving rise to dry spots along the wick.

SUMMARY OF THE INVENTION

It is an object of the present invention to provide a liquid supply arrangement which prevents air bubbles from entering the manifold, thereby ensuring the desired uniform supply of oil along the wick.

According to the present invention, there is provided an apparatus for supplying liquid to a heated surface, including a distribution gallery arranged to supply the liquid to the surface, the gallery having a bottom wall containing a series of spaced orifices each of which opens into an individual drop-forming chamber above the surface, the dimensions of each orifice and drop-forming chamber being such that some liquid always remains in each of the orifices over the range of temperatures from ambient to that of the heated surface.

BRIEF DESCRIPTION OF THE DRAWINGS

The foregoing and other object, features and advantages of the invention will become apparent from the following more particular description of the preferred embodiments, as illustrated in the accompanying drawings.

FIG. 4 is a partial longitudinal cross-section of the fuser oil manifold;

FIG. 5 is a partial cross-sectional view of a system for supplying oil to the fuser of FIG. 2;

FIG. 7 is a perspective view of a value used in the pump of FIG. 5.

DESCRIPTION OF THE PREFERRED EMBODIMENTS

Figure 1:
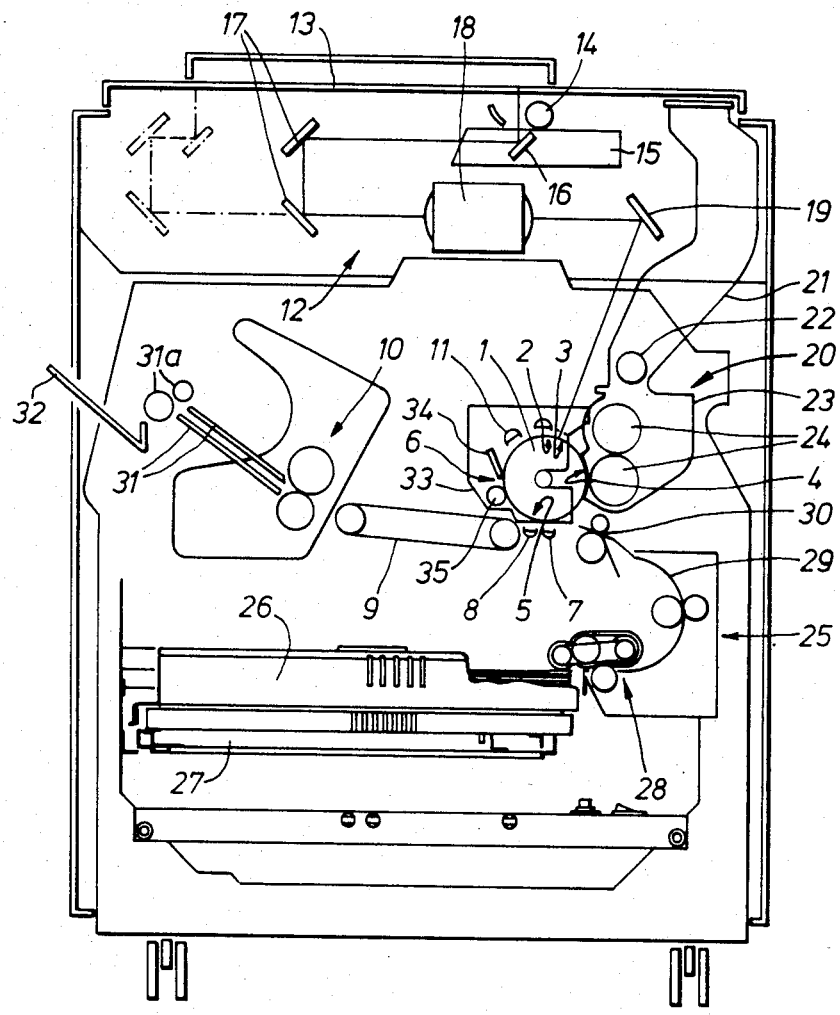
FIG. 1 is a diagrammatic cross-sectional view of a xerographic copying machine incorporating the invention.

Referring first to FIG. 1 there is shown a xerographic copying machine incorporating the present invention. The machine includes a photoreceptor drum 1 mounted for rotation (in the clockwise direction as seen in FIG. 1) to carry the photoconductive imaging surface of the drum sequentially through a series of xerographic processing stations: a charging station 2, an imaging station 3, a development station 4, a transfer station 5, and a cleaning station 6.

The charging station 2 comprises a corotron which deposits a uniform electrostatic charge on the photoreceptor. A document to be reproduced is positioned on a platen 13 and scanned by means of a moving optical scanning system to produce a flowing light image on the drum at 3. The optical image selectively discharges the photoconductor in image configuration, whereby an electrostatic latent image of the object is laid down on the drum surface. At the development station 4, the electrostatic latent image is developed into visible form by bringing into contact with it toner particles which deposit on the charged areas of the photoreceptor. Cut sheets of paper are moved into the transfer station 5 in synchronous relation with the image on the drum surface and the developed image is transferred to a copy sheet at the transfer station 5, where a transfer corotron 7 provides an electric field to assist in the transfer of the toner particles thereto. The copy sheet is then stripped from the drum 1, the detachment being assisted by the electric field provided by an A.C. de-tack corotron 8. The copy sheet carrying the developed image is then carried by a transport belt system 9 to a fusing station 10.

After transfer of the developed image from the drum, some toner particles usually remain on the drum, and these are removed at the cleaning station 6. After cleaning, any electrostatic charges remaining on the drum are removed by an A.C. erase corotron 11. The photoreceptor is then ready to be charged again by the charging corotron 2, as the first step in the next copy cycle.

The optical image at imaging station 3 is formed by optical system 12. A document (not shown) to be copied is placed on platen 13, and is illuminated by a lamp 14 that is mounted on a scanning carriage 15 which also carries a mirror 16. Mirror 16 is the full-rate scanning mirror of a full and half-rate scanning system. The full-rate mirror 16 reflects an image of a strip of the document to be copied onto the half-rate scanning mirror 17. The image is focused by a lens 18 onto the drum 1, being deflected by a fixed mirror 19. In operation, the full rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan.

At the development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and the toner, which is brought into developing engagement with drum 1 by a two-roller magnetic brush developing arrangement 24.

The developer image is transferred at transfer station 5, from the drum to a sheet of copy paper (not shown) which is delivered into contact with the drum by means of a paper supply system 25. Paper copy sheets are stored in two paper trays, an upper, main tray 26 and a lower, auxilliary tray 27. The top sheet of paper in either one of the trays is brought, as required, into feeding engagement with a common, fixed position, sheet separator/feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is a heated roll fuser. The image is fixed to the copy sheet by the heat and pressure in the nip between the two rolls of the fuser. The final copy is fed by the fuser rolls along output guides 31 into catch tray 32, which is suitably an offsetting catch tray, via output nip rolls 31*a*.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped-off particles then fall into the bottom of the housing, from where they are removed by an auger 35.

Figure 2:
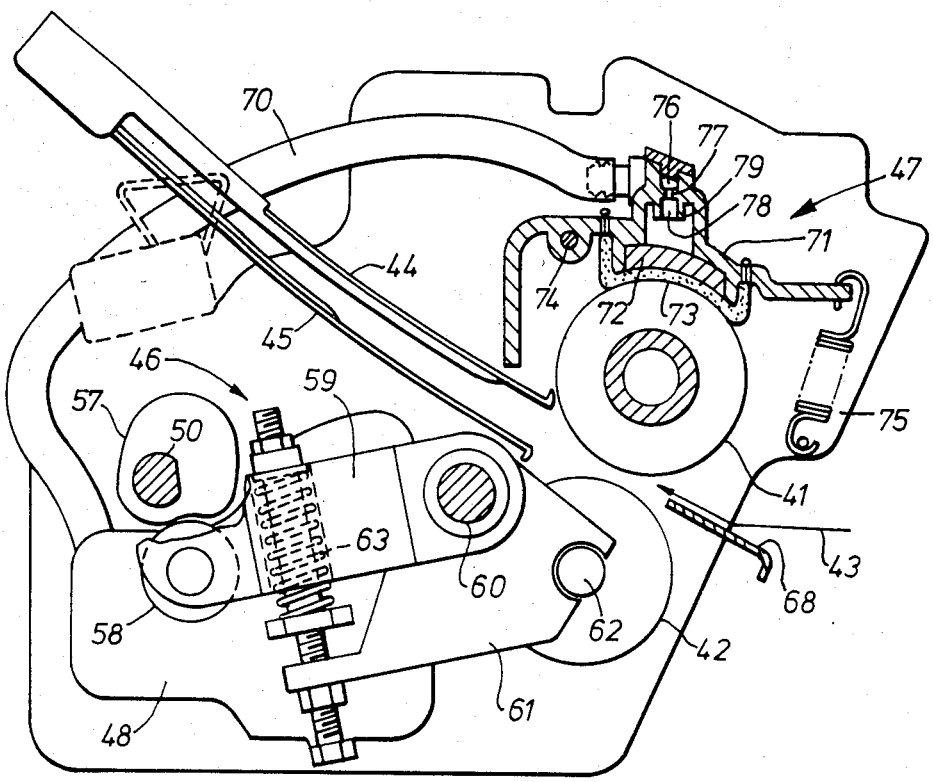
FIG. 2 is a lateral cross-section through a heated roller fuser apparatus incorporating the invention.

Referring now to FIG. 2, the principal components of the fuser 10 are the fuser roll 41, which is the upper roller, an the pressure roll 42, which is the lower roller. Copy paper sheets are fed in the direction of arrow 43 between rolls 41 and 42, and are delivered from the fuser by way of paper guides 44 and 45.

During a copy run, the rolls 41 and 42 are loaded together with an approximately constant force. The fuser roll 41 is driven, and the pressure roll 42 is an idler. At all other times, i.e. when the machine is off or in standby, the rolls 41 and 42 are separated. The pressure loading arrangement 46 will be described in more detail below with reference to FIG. 3.

A release oil (silicon oil) is supplied to the fuser roll 41 from a wick assembly 47 to which the oil is pumped from a tank 48 by means of a pump which will be described in more detail below with reference to FIGS. 5, 6 and 7.

The fuser housing is a sheet metal structure consisting of two side plates and two cross members. The top cross member has a continuation portion formed into a hook which locates on a rail on the machine frames to support the fuser module during insertion and withdrawal. The rear plate of the fuser locates in the machine through two dowels, while the front plate is fixed at three points. The shape of the top cross member encourages convection currents away from the cleaner and photoreceptor. A plastic cover, mounted on separators, prevents contact with the hot top cross-member during jam clearance, and obviates accidental disturbance of the temperature sensor.

FUSER ROLL ASSEMBLY

The fuser roll 41, which makes contact with the image, consists of an aluminum shell onto which is moulded a layer of silicone rubber which is loaded with alumina to increase its thermal conductivity. The pressure roll 42 consists of a steel shell with a PTFE coating. Heat is provided by a lamp passing through the centre of the fuser roll 41.

The surface temperature of the fuser roll is detected by a contact sensor containing a thermistor, and maintained by a controller which switches the lamp on and off as required to maintain the desired temperature. Different set temperatures during run and standby modes prevent the occurrence of large departures from the desired fusing temperature when the rolls are brought together, and enable an allowance to be made for the different response of the sensor to stationary and rotating rolls. An override feature holds the lamp on at the beginning of a copy run and off at the end of a copy run. The heater lamp is a 1100 watt lamp, and is fixed along the axis of the fuser roll, remaining stationary while the fuser roll rotates.

The fuser roll coating has a thickness of around 1.4 mm, and the outside diameter of the roll is about 42 mm, which is chosen to avoid synchronism with inter-document gaps for various copy sizes. The aluminum core of the fuser roll has a wall thickness of about 8 mm, to provide sufficient thermal conductivity, the resistance to roll bending.

Sintered stainless steel end caps locate on the outer diameter of the fuser roll 41 at three castellations to reduce heat losses and to avoid loss of location when the core expands when hot.

The pressure roll 42 has a coating of PTFE which is sprayed onto a thickness of approximately 0.1 mm which is sufficient to render the roll thermally passive for the lengths of time that it is normally in contact with the fuser roll. A mild steel core with a roll thickness of 4.5 mm is chosen to minimise roll bending. The diameter of the pressure roll increases towards the ends to minimise paper wrinkle problems.

PRESSURE LOADING SYSTEM

Figure 3:
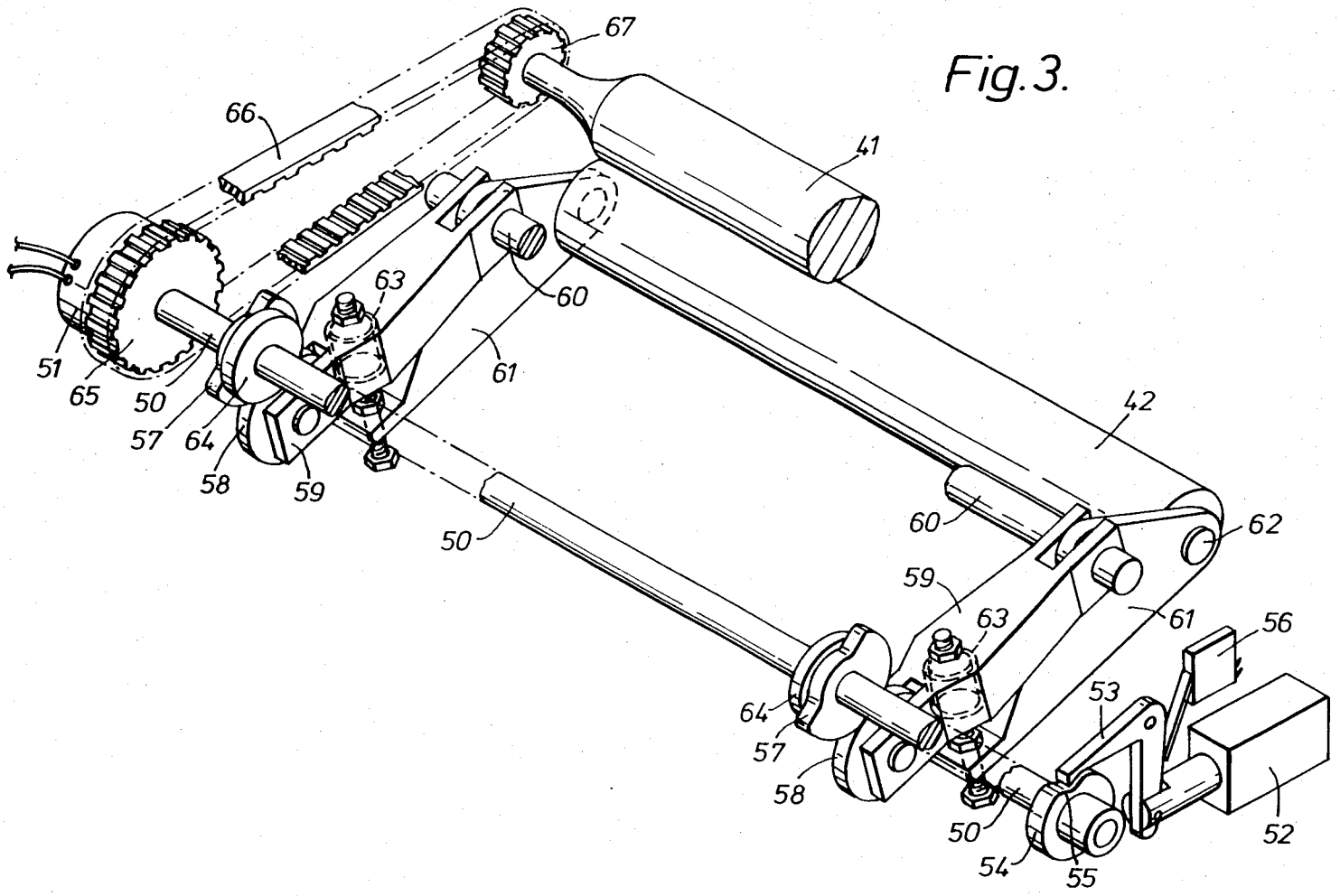
FIG. 3 is a perspective view of the roller assembly of the fuser of FIG. 2.

The pressure loading system will now be described with reference to FIGS. 2 and 3. On initiation of a copy run, drive is transmitted to a cam shaft 50 through a face plate clutch 51 from the main machine drive system (not shown). At the same time, a solenoid 52 is energised, pulling a pivoting latch arm 53 into contact with the side of a latch cam 54 fixed to the cam shaft 50. When the cam shaft 50 has rotated through about 180°, the latch arm 53 engages a notch 55 in the latch cam, and as it does so opens a microswitch 56. The opening of the microswitch 56 deenergises the clutch 51, leaving the cam shaft 50 locked in position.

Two cams 57 on the cam shaft 50 bear on cylindrical followers 58 that are carried at the end of upper load arms 59. The other ends of load arms 59 are pivotally mounted on a shaft 60, which extends the length of the fuser rollers. Also pivotally mounted on the shaft 60 are lower load arms 61, which carry at their ends remote from the cam shaft 50 the pressure roll 42. Pressure roll 42 is mounted for rotation as an idler by means of stub axies 62.

The upper load arms 59 and lower load arms 61 are urged apart from one another at their ends near the cam shaft 50 by means of compression springs 63. The springs are of such a size and rate that as the cams 57 rotate and act on cam followers 58, the load arms 59 and 61 initially move downwards together. The cam profiles of cams 57 are such that during this part of the movement, the cam followers move down relatively rapidly. This in turn causes the pressure roll 42 to be raised quite quickly into contact with the fuser roll 41. The cam profiles are such that once the pressure roll has contacted the fuser roll, a less rapid motion is produced, since at this point the springs 63 start to be compressed. As the cams 57 rotate into their final, locked position, with the maximum downward movement of the upper load arms 59, the springs 63 exert a predetermined pressure which causes a predetermined pressure to be applied between the fuser roll 41 and the pressure roll 42. Just after the correct force is applied in this way, the cams 57 stop rotating, and remain stationary during a copy run. Any subsequent movement of the pressure roll as paper enters the fuser nip is taken up by small changes in compression of springs 63, so that a nearly-constant load is maintained.

In order to compensate for the bending characteristics of the fuser roll and pressure roll, and because edge registration is used in the machine, the fuser and pressure rolls are slightly skewed (approximately 1°) relative to one another. Furthermore, the roll pressure at the registration side of the machine is set slightly higher than on the other side. The values of the skew and the differential pressures are chosen to minimise any tendency for copies to wrinkle by creating a larger nip width towards the copy edges, an to compensate against temperature variations on the fuser roll. This provides uniform fixing quality across the copy.

At the end of a copy run, or in the event of a power failure, the solenoid 52 is deenergised, and the return force exerted on the cam shaft by the resilience of the fuser roll (through the cams 57) drives the latch arm 53 from the notch in the latch cam 54. The energy released forces the rolls apart and drives the cam shaft to its rest position without other assistance. Rubber buffers 64, mounted on the cam shaft next to cams 57, prevent undue impact noise during this nip separation operation. In the separated position, the fuser and pressure rolls are about 2 mm apart from one another. This minimises radiative heat coupling between them.

A gear (not shown) mounted on the rear of the cam shaft 50 meshes with a gear in the main drive of the machine. Continuous drive to the fuser roll is provided from a pulley 65 on cam shaft 50 via a belt 66 to a pulley 67 mounted on the rear end cap of the fuser roll 41. The cam shaft 50, which is driven when clutch 51 is energised, rotates at half the rate of the fuser roll 41 to minimise the torque demand during the loading operation.

The nominal relative speed of paper through the fuser with respect to photoreceptor speed is chosen to avoid skips and smears and to minimise magnification errors on copies of long documents which are simultaneously in the fusing and transfer stations.

The direction of a copy sheet leaving the pre-fuser transport makes an angle of about 245° with the tangent to the line of contact between the fuser and pressure rolls. The lead edge of a copy sheet is directed through this angle into initial contact with the pressure roll by a small input guide 68 (FIG. 2). This imposes a relativey sharp turn in the paper path at this point, as indicated by the bend in arrow 43. The sharp turn imposed at this point increases the beam strength of the paper, thereby tending to eliminate any irregularities in its lead edge, and minimising any tendency to wrinkle. The relatively small diameter rolls in the fuser provide a self-stripping system, but the lower output guide 45 is brought into close proximity to the pressure roll to collect the copy, because the copies tend downwards as a result of the soft fuser roll. The output guides turn the copies upwards again to minimise any tendency to curl caused by the fuser rolls.

FUSER ROLL TEMPERATURE CONTROL

The surface temperature of the fuser roll is detected by a thermistor (not shown) lightly loaded against the fuser roll midway along its length. Temperature is maintained by a controller which switches (with a triac) the heater lamp on and off as required. The temperatures are set to around 194° C. in standby, and 174° C. in a copy run.

Overtemperature protection is provided by a thermal fuse. This is mounted in close proximity with the surface of the fuser roll, and is connected in series with the heater lamp. If the fuser roll temperature becomes excessive, the thermal fuse will blow, with consequent power loss to the fuser roll heater lamp. However, long before the temperature to blow the thermal fuse is reached, primary protection is effected by thermistor voltage interrogation for a temperature of about 215° C. At this temperature, the logic will cut power to the fuser and cause the 'overtemperature' diagnostic code to be displayed.

RELEASE OIL SYSTEM

Silicone oil release agent is pumped from the tank 48 by way of pipe 70 to the release oil applicator 47 (FIGS. 2 and 4). The applicator 47 consists of a moulded manifold arrangement 71 into which are secured a reservoir wick 72 and an applicator wick 73. Applicator wick 73 holds the reservoir wick 72 in place, and is secured at its ends by clip arrangements with twist tabs that locate over the manifold 71. The applicator wick 73 is lightly loaded into engagement with the fuser roll 41 to supply the silicone oil to it. Manifold 71 is pivotally mounted about a pivot shaft 74 at its left-hand edge as viewed in FIG 2, and a set of load springs 75 urge the manifold towards the fuser roll 41.

Oil is distributed to the reservoir wick 72 from supply gallery 76 that is connected directly to pipe 70. The oil in the supply gallery 76 is pumped under pressure through small tubular orifices 77, spaced at suitable intervals along the manifold 71 from front to rear of the fuser. Each tubular orifice 77 opens into a drop-forming chamber 78 which is bounded by an annular wall 79. As the oil is pumped into the supply gallery 76, it passes down through the orifices 77, and fills the drop-forming chambers 78. Drops then form in chambers 78, assisted by walls 79, the drops from time to time breaking away and falling onto the reservoir wick 72. In order to prevent the wick rising into contact with the drops of release oil in the drop-forming chambers 78, and so prematurely releasing the drops, spacer walls 80 are provided on each side of the drop-forming chambers.

The silicone oil used is one which has a high viscosity, which tends also to have a relatively high co-efficient of thermal expansion. The dimensions of the drop-forming chamber 78 and orifice 77 are chosen to be such that on cooling of the fuser from operating temperature to ambient, the oil does not recede completely into the supply gallery 76, but some always remains in orifices 77 even if a drop has only just broken away from drop-forming chamber 78. This prevents the ingress of air into supply gallery 76. If the ingress of air were permitted, the result would be that oil would be prevented by the build up of air from replenishing the reservoir wick.

Referring now to FIG. 5, the silicone oil is contained in the tank 48 from which it is pumped by means of a pump 81 to the manifold 71. Pump 81 is described in more detail below with reference to FIGS. 6 and 7. The pump is operated from a crank shaft 82 connected to a small geared motor 83 with an output speed of about 4 revolutions per hour. Oil contained within the tank 48 is drawn into the pump at inlet 84, and is pumped out at outlet 85 into pipe 86 which is connected directly to pipe 70 by means of a connector which passes through the end wall of tank 48. The tank 48 has a lid 87 for replenishment of the oil within the tank.

Figure 6:
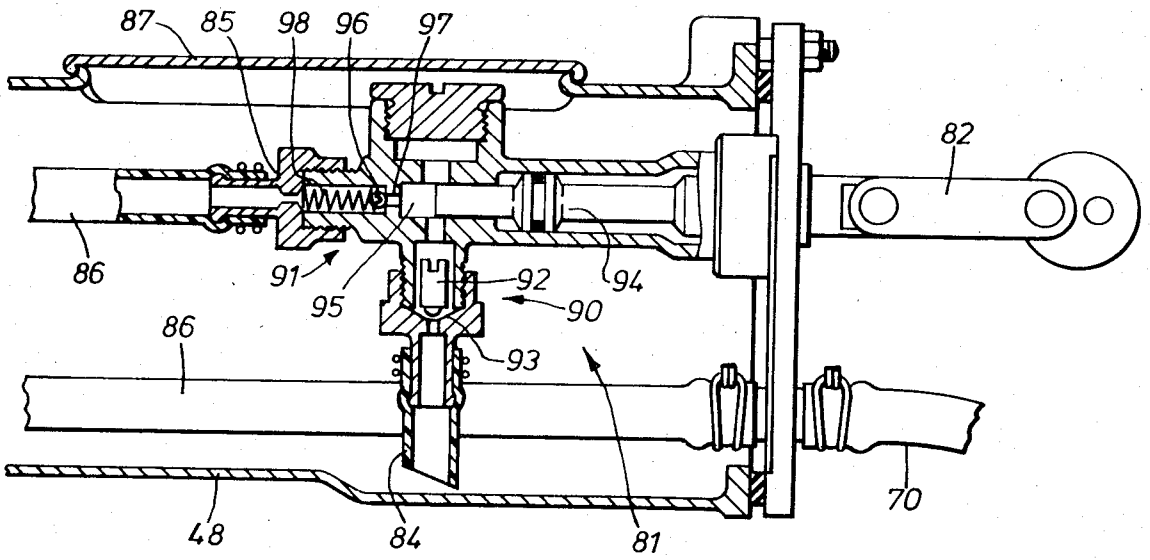
FIG. 6 is a cross-sectional view of a pump for the release oil used in the apparatus of the invention.

Referring now to FIG. 6, the pump 81 has an inlet valve arrangement 90 and an outlet valve arrangement 91. The inlet valve 90 contains a slug 92 which lifts away from its seat 93 when the piston 94 of the pump is moved to the right as seen in FIG. 6. The high viscosity of the silicone oil causes the slug 92 to lift allowing the oil to enter the pump through inlet 84, and to be drawn into the main pump chamber 95. As this is taking place, oil is prevented from being sucked back from the outlet 85 of the pump by means of the outlet valve 91, which consists of a ball 96 that is lightly loaded against its seat 97 by means of a spring 98.

When the piston 94 has reached the end of its stroke, and returns to the left, slug 92 returns to its seat 93, forming a seal, under the combined action of gravity and the movement of the oil. Once the inlet valve 90 has been closed in this way, the piston forces oil from the pump chamber 95 past the ball 96 and into the outlet 85 of the pump.

The slug 92 of the inlet valve 90 is shown in enlarged perspective form in FIG. 7. Its lower end has a domed part 100 for cooperation with the valve seat 93, and a body part 101 fo generally triangular cross-section. The upper part of the slug 92 is formed with a hollow to define a 'flight' structure 102. These features of the slug 92 help to keep it alinged within inlet valve 90 and provide optimum performance with the high viscosity oil.

SWITCH-OFF STRATEGY

It is desirable to have the machine switch off the fuser in accordance with its history of use during a certain time period.

Timing the machine to switch off the fuser a fixed number of hours after mains switch-on (or reactivation following a previous time out) has the disadvantages of annoying the occasional late worker and subjecting the fuser roll to a double period at full temperature if it is reactivated. Timing out of a machine if unused for so many hours is disadvantageous in environments where the machine is operated only very periodically. Combining and expanding the above two time out methods provides the basis on which a suitable current switch-off strategy has been developed for the fuser.

The strategy employs 3 modes of switching; the x, y and z modes. During the x and y modes, the fuser roll operating and standby temperatures remain unaltered, but the 'z' mode, the fuser power is switched off. The times in the x, y and z modes may advantageously be 8, 2 and 4 hours respectively. Although $x+y=10$ hours, it is assumed that most machine users switch off their machines at the end of a normal working day of average duration, less than 9 hours.

From machine switch-on, any number of copies can be made without affecting the time the machine remains in the 'x' mode. After 'x' hours the machine will automatically switch to the 'y' mode. If copies are not made during 'y' hours, the machine will automatically switch to the 'z' mode and immediately remove power from the fuser roll heater. If no further copies are made during 'z' hours, the machine will automatically reactivate to repeat the x, y, z sequence as soon as the next copy is made.

When the machine is used for copying the 'y' mode, the machine will automatically re-commence the full 'y' mode before going into the 'z' mode. Similarly, having once reached the 'z' mode, if the machine were used during the 'z' mode, the fully 'y' mode would automatically re-start.

When the machine is used in the 'z' mode, the normal warm-up period (fuser cold) will be necessary before copies can be made.

In the case of power failure or after 'z' time out, the entire x, y, z sequence will reactivate upon machine switch-on.

We claim:

1. Apparatus for forming toner images on copy substrates including a heat and pressure fuser and a high viscosity release oil applicator therefor wherein said release oil applicator comprises:

a distribution gallery arranged to supply said release oil to a surface of said heat and pressure fuser, said gallery having a bottom wall;

a plurality of orifices in said bottom wall; and a series of individual drop-forming chambers disposed above said surface, each of said orifices providing an oil flow path between said gallery and one of said drop-forming chambers each orifice and drop-forming chamber having dimensions which cause some oil to remain in each of said orifices as said fuser cools from its operating temperature to ambient temperature to thereby preclude air entering said gallery upon cooling of said release oil.

2. The apparatus of claim 1 including pump means to deliver the oil to the distribution gallery.

3. The apparatus of claim 1 including a support structure for supporting a wick in contact with said surface, the distribution gallery being situated above the wick.

4. The apparatus of claim 3 including spacer members adjacent said drop forming chambers to space the wick away from the drop-forming chambers.

5. The apparatus according to claim 1 including a support structure for supporting a wick in contact with the surface, the distribution gallery being situated above the wick.

* * * * *